US006644473B2

(12) United States Patent
Kohler

(10) Patent No.: US 6,644,473 B2
(45) Date of Patent: Nov. 11, 2003

(54) CARTON FOR HOLDING AND DISPLAYING BALLS

(75) Inventor: Karl A. Kohler, Bartlett, IL (US)

(73) Assignee: Smurfit-Stone Container Corporation, St. Louis, MO (US)

( * ) Notice: Subject to any disclaimer, the term of this patent is extended or adjusted under 35 U.S.C. 154(b) by 0 days.

(21) Appl. No.: 09/961,777

(22) Filed: Sep. 24, 2001

(65) Prior Publication Data

US 2003/0057121 A1 Mar. 27, 2003

(51) Int. Cl.[7] ..... B65D 85/00; B65D 25/54; B65D 5/00

(52) U.S. Cl. ..... 206/315.9; 206/779; 206/780; 229/149

(58) Field of Search ..... 206/315.9, 757, 206/779, 780, 782, 486, 490, 588, 590; 229/103.2, 103.3, 190, 195–197, 198.2, 142, 144, 145, 148, 121, 149, 150, 159

(56) References Cited

U.S. PATENT DOCUMENTS

| | | | | |
|---|---|---|---|---|
| 1,149,805 A | * | 8/1915 | Barrabee | 229/150 |
| 1,850,829 A | * | 3/1932 | Cole | 229/144 |
| 2,301,042 A | | 11/1942 | Hanson | |
| 3,123,204 A | * | 3/1964 | Baker et al. | 206/315.9 |
| 3,193,175 A | * | 7/1965 | Moreton | 229/149 |
| 3,987,893 A | | 10/1976 | Hanson | |
| 4,452,355 A | | 6/1984 | Benham | |
| 4,779,726 A | * | 10/1988 | Pratt | 206/315.9 |
| 5,115,965 A | | 5/1992 | Alepuz | |
| 5,368,225 A | * | 11/1994 | Ritter | 229/149 |
| 6,036,010 A | | 3/2000 | Seyffert et al. | |
| 6,199,692 B1 | * | 3/2001 | Van Ness et al. | 206/315.9 |

FOREIGN PATENT DOCUMENTS

| | | | | |
|---|---|---|---|---|
| EP | 58641 A1 | * | 8/1982 | B65D/5/06 |

* cited by examiner

*Primary Examiner*—Mickey Yu
*Assistant Examiner*—John G Pickett
(74) *Attorney, Agent, or Firm*—Paul M. Denk

(57) ABSTRACT

A carton is provided for displaying balls. The has top, bottom, front, back, and side walls. The top and bottom walls have openings therein sized and shaped to engage the ball substantially along the full circumference of the holes. Additionally, the carton includes interior braces, preferably at the four corners of the box. The ends of the braces have curved edges, the curvature of which correspond to the curvature of the ball, such that the ends of the braces contact the ball substantially along the full length of the braces. The braces preferably urge the ball upwardly (or downwardly) to urge the ball against the edge of the hole in the top (or bottom) wall. The size and shape of the braces and of the holes allow for a frictional engagement of the ball by the carton to reduce the possibility of unassisted movement of the ball relative to the carton. Additionally, the blank from which the carton is formed allows for the carton to be formed easily, quickly, and without the use of glue, staples, or other fastening means.

16 Claims, 5 Drawing Sheets

CARTON FOR HOLDING AND DISPLAYING BALLS

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to cartons, and, in particular, to a paperboard carton formed from a blank, to hold and display balls.

There are numerous designs for paperboard cartons to hold balls, such as basketballs, soccer balls, volley balls, baseballs, etc. Many of the cartons, especially for the larger balls, display the ball, rather than enclosing the whole ball. These cartons often have only a one or two lines of contact with the ball in the carton or otherwise do not have a good frictional contact with the ball. Hence, the ball can move or turn in the carton. Movement of the ball in the carton can weaken the holding force of the carton on the ball, as well as the carton itself.

When manufacturers package their balls in display cartons, the balls are arranged to display the manufacturers' marks and logos. Because the currently available cartons allow for unassisted movement of the ball (as compared to movement due to consumer handling of the ball), the manufacturers' marks and logos become hidden. It would be beneficial to the manufacturers if the carton would resist such unassisted movement of the ball relative to the carton.

Further, many of the cartons currently available are difficult to fold or require complex machinery to form the carton from the blank.

BRIEF SUMMARY OF THE INVENTION

A new and improved carton for holding and displaying a ball is provided. The carton has a top wall, a bottom wall, a front wall, a back wall, and side walls. The top-to-bottom height of the carton is less than the diameter of the ball. Hence, the top and bottom walls have holes therein through which the ball protrudes when received in the carton. The holes are sized and have a curvature corresponding to the curvature of the ball at a plane of contact between the top and bottom walls and the ball so that the hole edges engage the ball substantially along the full circumference of the openings. The carton also includes interior braces which extend into the carton. Preferably, the braces are positioned at the corners of the box and extend diagonally toward either the top or bottom wall of the carton. The braces have a curved end edges which are sized and to engage the ball substantially along the full length of the respective edges. The engagement of the top and bottom walls and of the braces with the ball substantially preventing unassisted movement of the ball relative to the carton. Further, the upward direction of the braces urges the ball against the top wall hole edge to reinforce the engagement of the top hole edge with the ball, and hence, increase the frictional engagement of the hole edge with the wall.

Preferably, the carton is formed from a one-piece, unitary paperboard or cardboard blank. The blank allows for the carton to be folded quickly and easily, and without the use of glue, staples or other forms of chemical or mechanical fasteners. The blank includes a back panel which forms the back of said carton; a top panel and bottom panels hingedly connected to opposite ends of the back panel for forming the top and bottom walls of the carton. An inner front panel is hingedly connected to an end of said bottom panel along a side of said bottom panel opposite the back panel. An outer front panel is hingedly connected to an end of the top panel along a side of said top panel opposite said back panel. Side panels are hingedly connected to opposite sides of said top panel to form said carton side walls. The inner front panel has a cut-out extending inwardly from an end of said inner front panel toward said bottom panel.

Flaps are hingedly connected to ends of said side panels and extending beyond said top panel to be on opposite sides of said outer front panel when said blank is laid flat. The flaps include a neck having a bottom edge which, when said blank is folded to form said carton, is generally aligned with a bottom edge of said inner front panel cutout. An ear extends from the neck in a direction (preferably perpendicularly) to allow said ear to be tucked behind said bottom edge of said inner front panel cutout when the carton is formed. Thud, said blank is folded into a carton, the flap neck is on one side of said inner front panel and the ends of said ears are on an opposite side of said inner front panels. The flaps engage said inner front panel to maintain said carton in a folded form without the use of glue, staples, or other chemical (i.e., glue) or mechanical (i.e., staples) fasteners.

The blank also includes slots formed along the hinge line between said bottom panel and said inner front panel and corresponding tabs hingedly connected to, and extending from, an end of said outer front panel. When the carton is folded, the tabs are inserted into the slots. The engagement of the tabs and slots holds the outer front panel in place relative to the rest of the panels, and further helps to maintain the carton in its folded form without the use of any fastening means, such as adhesives or staples.

The side walls of the carton are made of an outer side panel (which is connected to the top panel) and an inner side panel (which is connected to the bottom panel). The inner and outer side panels are connected by connecting panels. The connecting panels include a brace forming panel to form the rear braces of the carton. Additionally, forward brace forming panels are hingedly connected to an end of the said inner side panels and operatively connected on the sides of the said inner front panel and form the forward braces when said carton is formed from said blank. The forward brace forming panels each comprise a two triangular sections hingedly connected together, so that the forward braces are generally V-shaped in elevation or vertical cross-section. All the braces, as noted above, preferably are offset from the vertical and horizontal axis of the carton, so that the ends or edges of the braces are directed toward the top (or bottom) walls of the carton when the carton is formed.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 1:
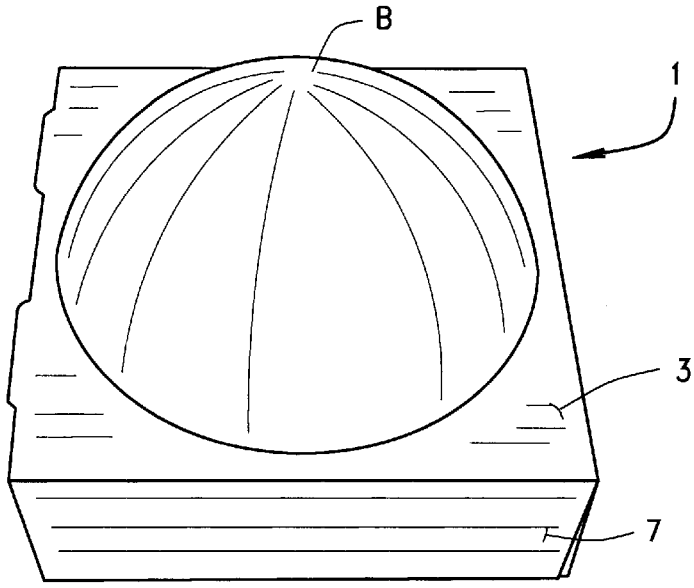
FIG. 1 is a perspective view of a carton of the present invention holding a ball.

A carton 1 of the present invention is shown generally in FIG. 1 with a ball B received in the carton. The carton 1 is generally rectangular, having a top surface 3, a bottom surface 5, side surfaces 7 and 9, a front surface 11, and a back surface 13. The carton has a height (from top to bottom) less than the diameter of the ball B. Hence, the top and bottom surfaces have openings 15 and 17, respectively through which the ball extends. Hence, the carton top and bottom surfaces define planes through which the ball extends. The openings 15 and 17 are sized and shaped such that the edges 19 of the openings define a radius or curvature corresponding to the radius or curvature of the ball at the planes defined by the carton top and bottom surfaces. Hence, the hole edges 19 contact and frictionally engage the ball substantially along the full extent of the edges 19. Additionally, as seen in FIGS. 6–9, the carton includes internal rear and forward braces 21*a, b,* which are angled (i.e., not parallel) relative to the top and bottom surfaces 3 and 5, such that the edges 23 of the braces face or extend toward the top surface 3. Thus, the braces 21*a, b* urge the ball into contact with the top hole 15 to reinforce the engagement of the top hole 15 with the ball B. The braces 21*a, b,* which are preferably at the four corners of the carton, their edges 23 are sized and shaped to contact and frictionally engage the ball substantially along the full extent of the edges 23. Hence, the edges 23 define curves having radii which correspond substantially to the curvature of the ball along the line of contact between the ball and the brace. The grip of the opening edges 19 and brace edges 23 on the ball is not sufficiently strong to prevent someone from moving the ball in the carton. However, the contact and frictional engagement of the brace edges 23 and of the opening edges 19 with the ball are strong enough to prevent unassisted movement of the ball relative to the carton 1. By substantially preventing unassisted movement of the ball B relative to the carton 1, the ball will generally maintain its original position in the carton (i.e., the position in which the ball was placed when originally packed in the carton). Usually, the balls are positioned in display cartons, such as the current carton 1, to display the manufacturer's trademark or logo. Hence, the trademark or logo of the manufacturer will not become hidden view due to unassisted movement of the ball, as can happen with currently available ball displaying cartons.

The Carton Blank

Figure 2:
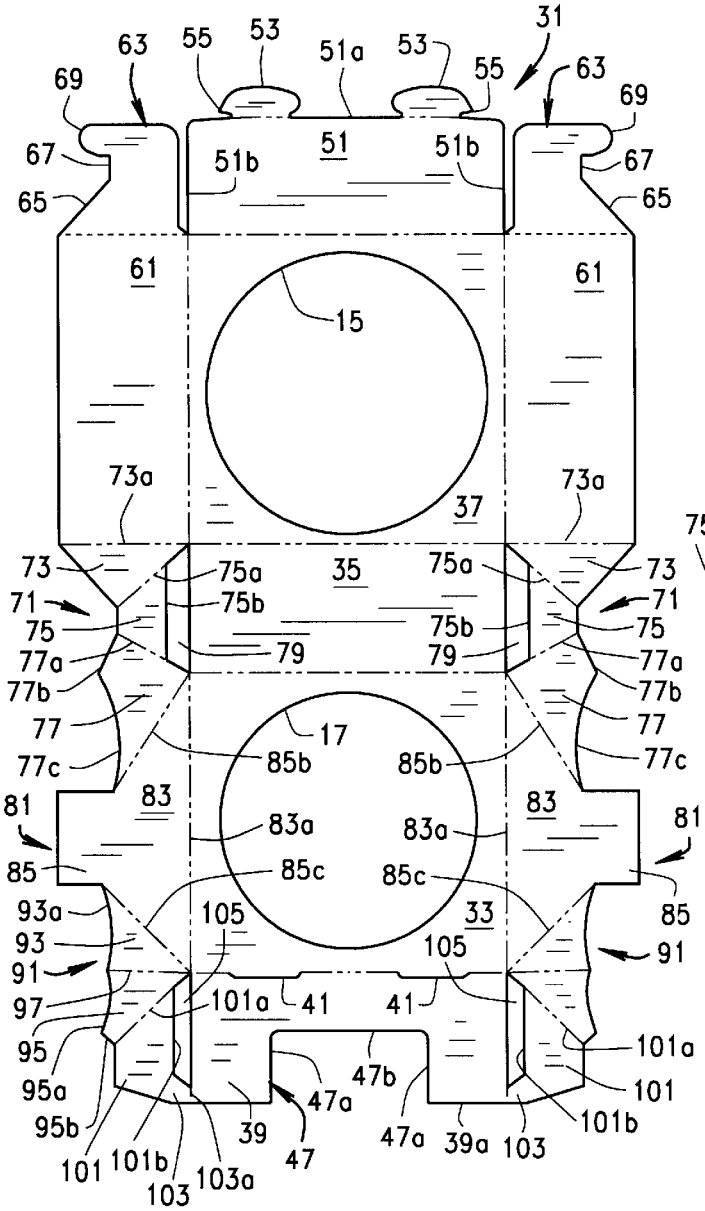
FIG. 2 is a plan view of the blank from which the carton is formed.

The blank 31 from which the carton 1 is formed is shown in FIG. 2. The blank 31 has a bottom panel 33, a back panel 35, and a top panel 37 which form the bottom 5, the back 13, and the top 3 of the carton 1, respectively. The bottom, back, and top panels are hingedly connected together along fold lines, with the top and bottom panels 33 and 37 being on opposite sides of the back panel 37.

An inner front panel 39 is hingedly connected to the bottom panel 33 along a fold line. A pair of spaced apart, generally trapezoidal cuts 41 are made in the fold line between the bottom panel 33 and the inner front panel 39. The cuts 41 form slots 43 (FIG. 5) and tabs 45 (FIG. 4) when the inner front panel 39 is folded up. Additionally, a rectangular cutout 47 having side edges 47*a* and a bottom edge 47*b* extends inwardly from the free or forward edge 39*a* of the panel 39. As can be appreciated, the inner front panel 39 defines the portion of the carton front 11 which is visible from the inside of the carton 1.

An outer front panel 51 is hingedly connected to the free end of the top panel 37 along a fold line. A pair of tabs 53 extend from the free or forward end 51*a* of the outer top panel 51. The tabs 53 are undercut, as at 55, and are positioned on the outer front panel 51 to be aligned with the slots 43 formed by the cuts 41 along the hinge line between the bottom panel 33 and the inner front panel 39. As can be appreciated, the outer front panel 51 defines the portion of the carton front 11 which is visible from the outside of the carton 1.

A pair of outer side panels 61 are hingedly connected to the sides of the top panel 37. The outer side panels 61 define the portions of the carton sides 7 and 9 which are visible from the outside of the carton 1. The outer side panels 61 have a length equal to the length of the top panel 37 and a width equal to the length of the back panel 35. A flap 63 is hingedly connected to each of the outer side panels 61 at the forward end of the outer side panels 61 to be adjacent, but not connected to, the sides 51*b* of the outer front panel 51. The flaps 63 each have a generally trapezoidal base 65, a rectangular neck 67, and an ear 69 extending outwardly from the outer edge of the neck 67.

Connecting panels 71 are hingedly connected to the bottom of the outer side panels 61. The connecting panels 71 are adjacent, but not connected, to the back panel 35. The connecting panels 71 include three sections: a first triangular section 73; a second, generally trapezoidal, section 75, and a third somewhat bat-wing shape section 77. The first triangular section 73 is hingedly connected to the outer side panels 61 along edges (and fold lines) 73*a*. The second section 75 is hingedly connected to the first panel 73 along a side (and fold line) 75*a* and has an inner edge 75*b* which is spaced from the side edges of the back panel 35. The third section 77 is hingedly connected to the second panel along a side (and fold line) 77*a*. Because the second section edge 75*b* is spaced from the side of the back panel 35, the fold lines 75*a* and 77*a* do not extend the full length of the sides of the second section 75; and, a gap 79 is formed between the second sections 75 and the back panel 35. The outer edge of the third section 79 is, as noted, somewhat bat-winged in shape. It has a first edge 77*b* which extends downwardly and outwardly from the end of the fold line 77*a* (with reference to FIG. 2) and a second edge 77*c* which is curved, and defines a radius equal to the radius of the ball B. The two third sections 77 form the rear braces 21*a*; and the edge 77*c* is the brace edge 23.

Inner side panels 81 are hingedly connected to the side edges of the bottom panel 33 and to the connecting panels 71 along respective hinge or fold lines. The inner side panels 81 define the portions of the carton sides 7 and 9 which are visible from the inside of the carton 1. The inner side panels 81 have a base section 83 which is generally trapezoidal in shape and has an bottom edge 83*a* and sides 85*b, c*. The bottom edge 83*a* extends the length of the bottom panel 33, and defines the fold line between the bottom panel 33 and the inner side panel 81. The side 85*b* is adjacent the connecting panel third section 77, and defines the fold line between the third section 77 and the inner side panel 81. As described below, the side 85*c* is adjacent a forward brace panel 91, and defines a fold line between the brace panel 91 and the inner side panel 83. A rectangular arm 85 extends from the base, and is generally centered with respect to the base inner edge 85*a*. The base 83 and arm 85, in combination, have a width generally equal to the width of the outer side panel 61.

The forward brace panel 91, as noted, is hingedly connected to the inner side panel 81 along the side panel edge 85*c*. The brace panel 91 is formed of two generally triangular sections 93 and 95, which are divided by a fold line 97 which is aligned and co-linear with the fold line between the bottom panel 33 and the inner front panel 39. The first brace panel section 91 has a curved outer edge 93*a* which defines one of the brace edges 23. Thus, the outer edge 93*a* has a curvature substantially equal to the curvature of the ball B along the line of contact between the edge 93*a* and the ball. The second section 95 also has a curved outer edge 95*a* which forms one of the brace edges 23 and hence has a curvature substantially equal to the curvature of the ball B along the line of contact between the edge 95*a* and the ball. The outer edge of the second section 95, however, is chamfered, as at 95*b*; the chamfered edge 95*b* being generally parallel to the fold line 85*c*.

A connecting flap 101 is hingedly connected to the brace panel 91 along a hinge line 101*a* between the brace panel second section 95 and the flap 101. The flap 101 extends generally parallel to the inner front panel 39, and has an inner edge 101*b* which is parallel to, but spaced from, the side edge of the inner front panel 39. An ear 103 extends from the forward end of the flap 101 and is connected to the inner front panel 39 along a hinge line 103*a*. Because the flap inner edge 101*b* is spaced from the inner front panel 39, the inner front panel 39, the flap 101, the flap ear 103, and the forward brace second section 95 define a gap 105.

Folding the Blank To Form The Carton

Figure 3:
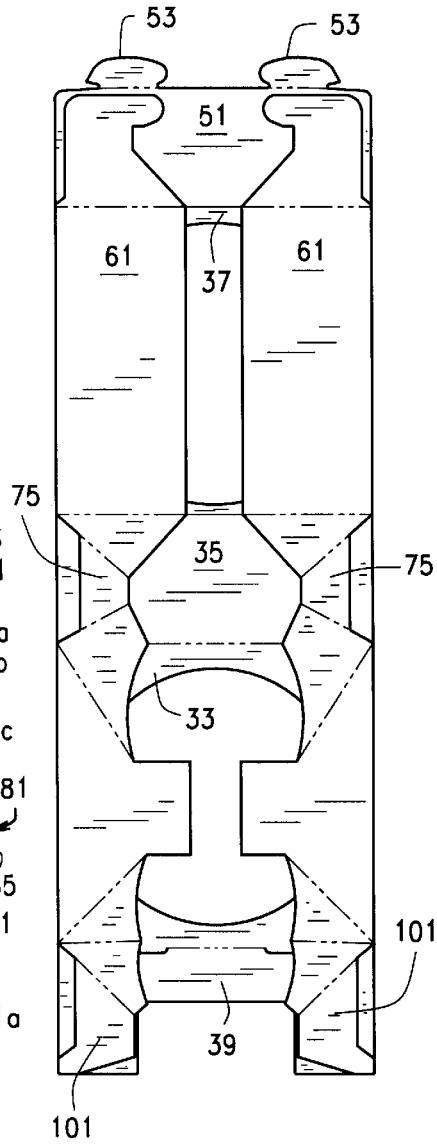
FIG. 3 is a plan view of the blank with the side portions folded over, as a first step in forming the carton.

To fold the blank 31 to form the carton 1, the flaps 63, outer side panels 61, connecting panels 71, the inner side panels 81, the forward brace panels 91, and the flaps 101 (i.e., the side portions of the blank) are folded over the outer front panel 51, the top panel 37, the back panel 35, the bottom panel 33, and the inner front panel 39, respectively, (i.e., the middle or center portion of the blank) to lie flat against, the center portion of the blank, as seen in FIG. 3. If desired, the connecting panel second sections 75 can be adhered to the back panel 35, for example by a conventional adhesive or conventional mechanical means, such as staples. Similarly, the connecting flap 101 can be adhered to the inner front panel 39, with conventional adhesive or by mechanical means. The securement of the blank 31 at the noted areas may ease folding of the blank into the carton. However, the securement of the blank in the position shown in FIG. 3, using either adhesive or mechanical means, is not required to fold the carton from the blank, or to hold the carton in its folded form. If glued or stapled, as noted, the blank can be prefolded, and then transported to the ball manufacture in the intermediate form (as seen in FIG. 3), to allow for shipping of the blanks in a generally flat form. If no gluing or stapling is to be performed, the blanks can be shipped flat, either fully laid out (as seen in FIG. 2), or prefolded, (as seen in FIG. 3).

Figure 4:
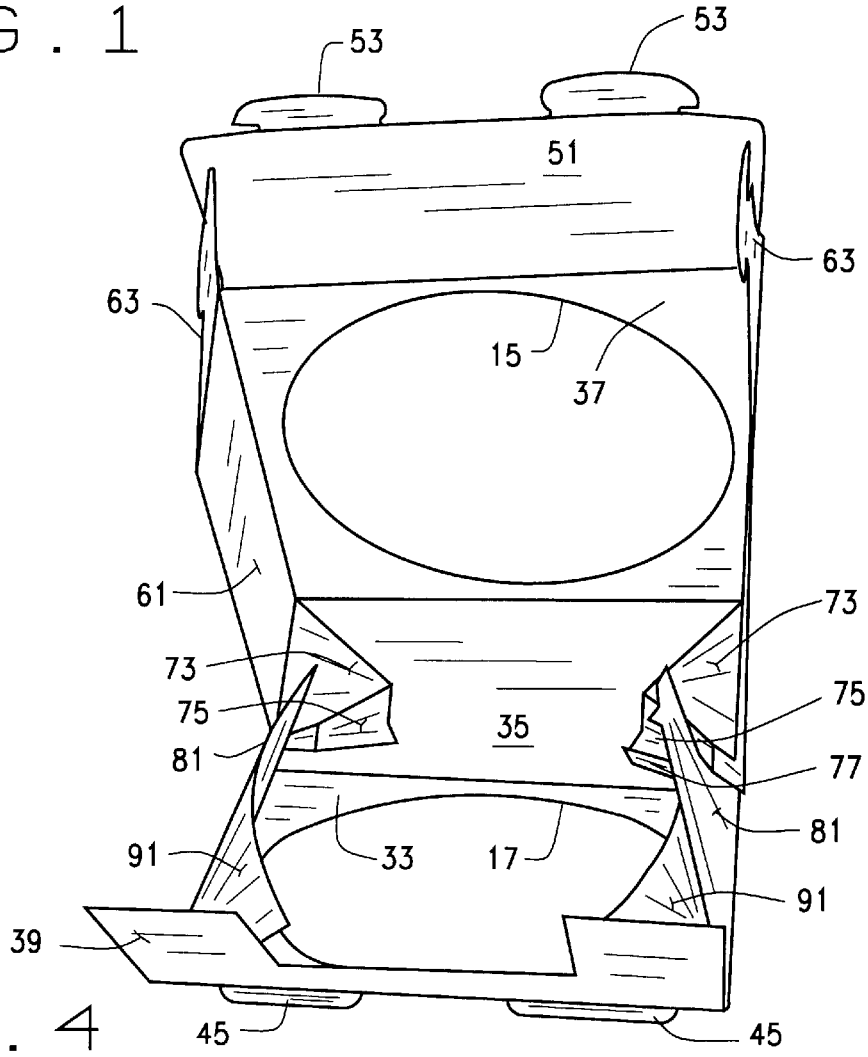
FIG. 4 is a front perspective view of the carton, showing the blank being folded from the position of FIG. 3, to form the carton.

After the blank 31 has been folded to the position shown in FIG. 3, the blank is folded along the fold lines between the back panel 35 and the top and bottom panels 33 and 37, respectively, as seen in FIG. 4, until the top and bottom panels are generally parallel with each other. Because the connecting panel second section 75 is in contact with the back panel 35, as the blank is folded around the fold line between the top and back panels 37 and 35, the outer side panels 61 begin to fold downwardly. Additionally, because the flap 101 is connected to the inner front panel 47, as the blank is folded about the fold line between the back and bottom panels 35 and 33, the inner side panels 81 bend upwardly; the connecting panel first section 73 begins to overlay the connecting panel second section 75; and the connecting panel third section 77 extends into the chamber defined by the carton to form the rear braces 21*a*.

Figure 6:
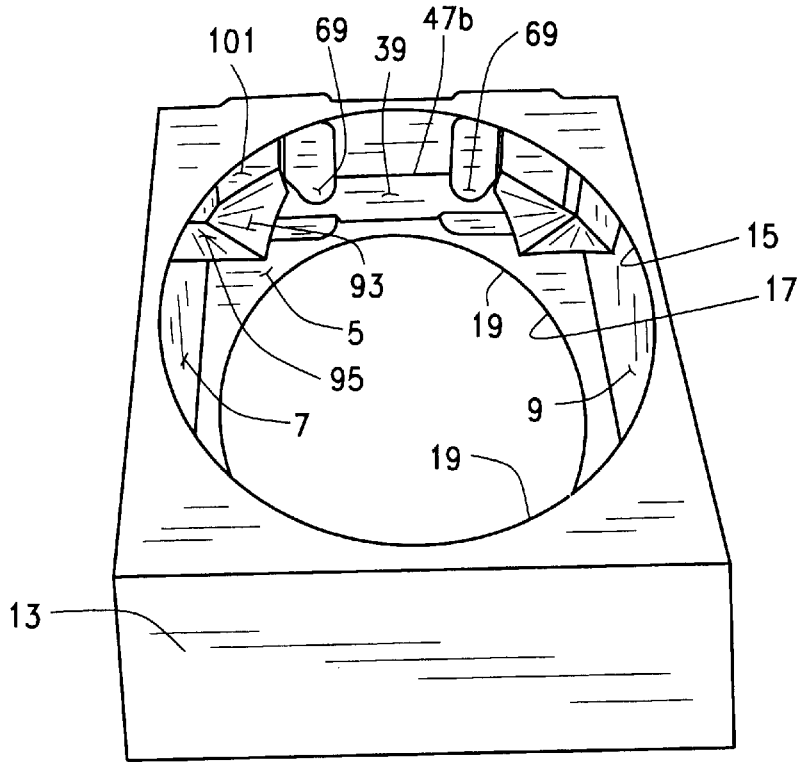
FIG. 6 is a rear perspective view of the carton, showing the interlocking of the panels which comprise front wall to lock the carton closed.
Figure 7:
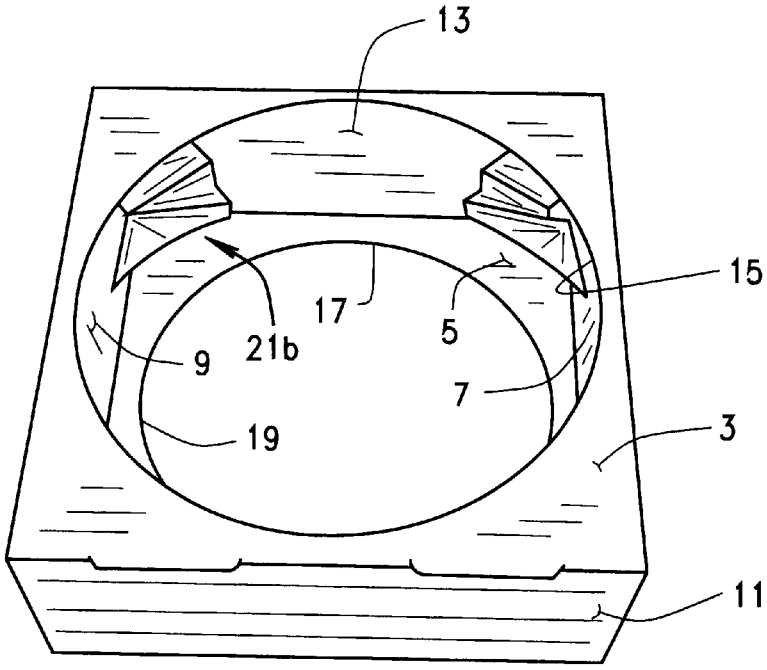
FIG. 7 is a front perspective view of the carton, showing the carton rotated 180° relative to FIG. 6.
Figure 8:
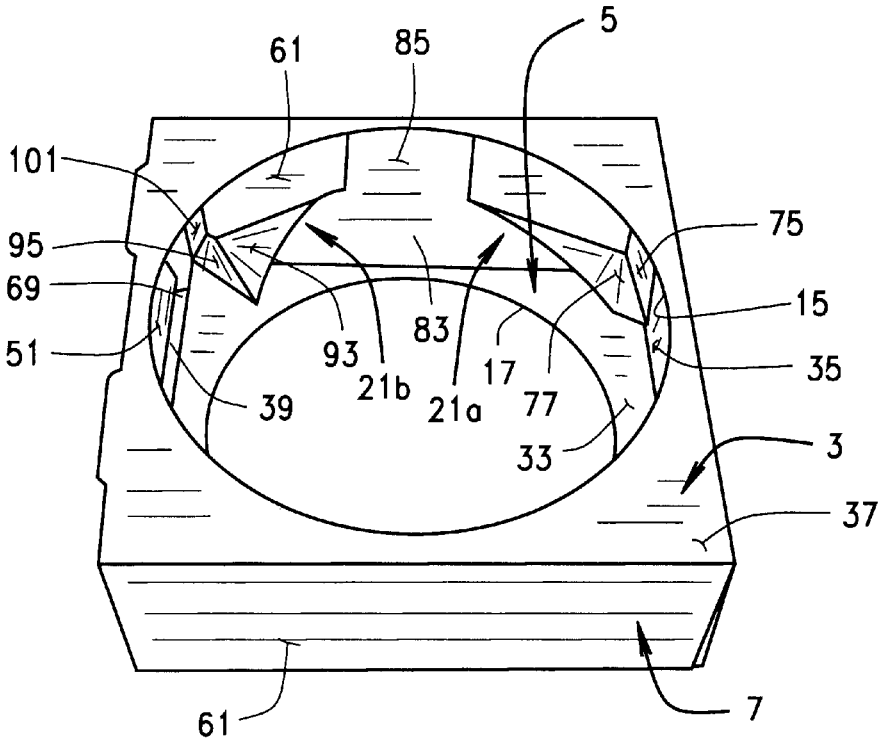
FIG. 8 is a side perspective view of the carton, showing the carton rotated 90° relative to FIGS. 6 and 7.
Figure 9:
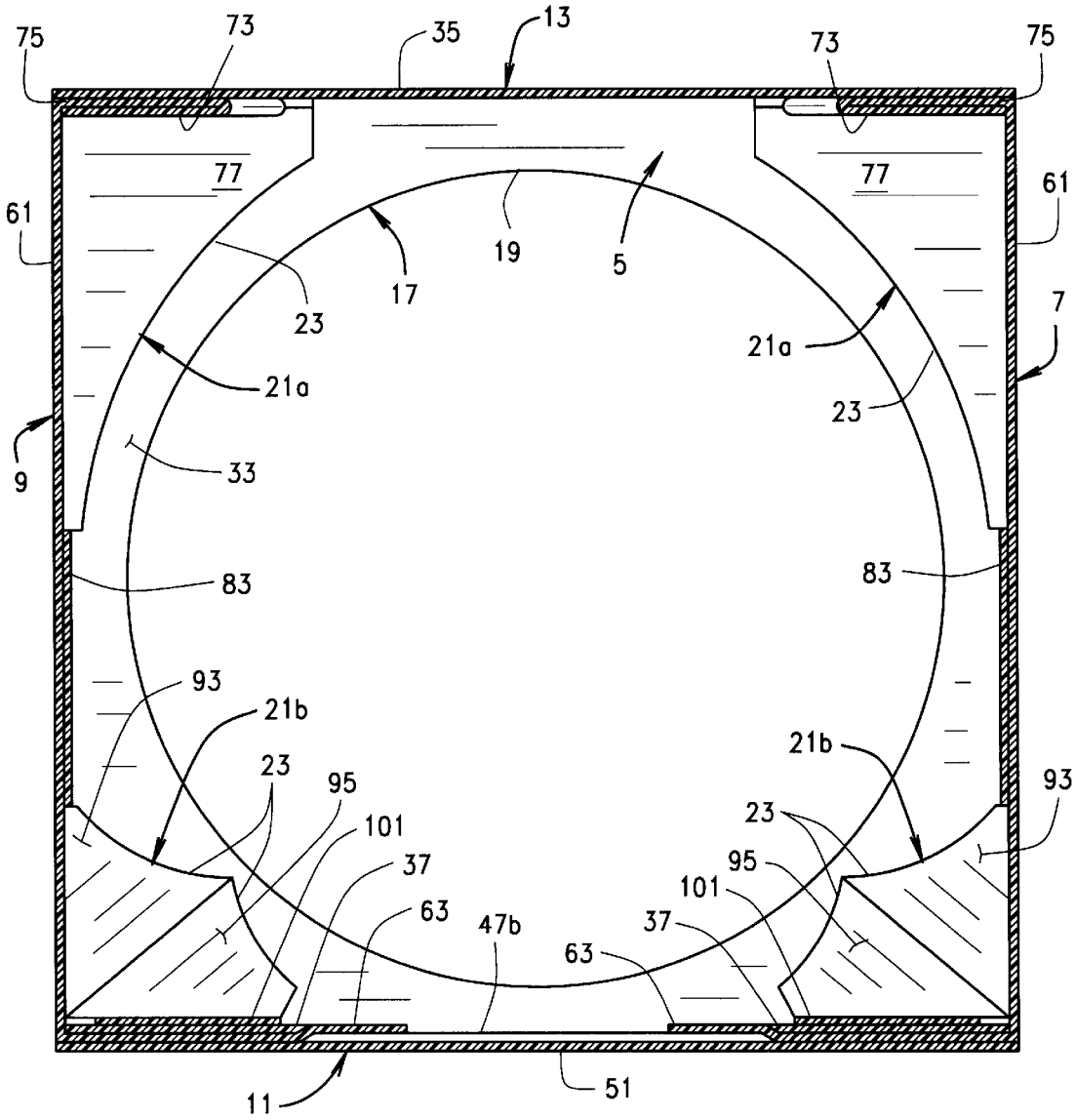
FIG. 9 is a horizontal cross-sectional view of the carton.

The inner front panel 39 is also folded upwardly relative to the bottom panel 33 along the fold line between the inner front panel and the bottom panel. As this occurs, the forward brace panel 91 folds or bends along the hinge lines 85*c*, 97, and 101*a* to take on a generally V-shape as best seen in FIGS. 6 and 9 to form the forward braces 21*b*.

Figure 5:
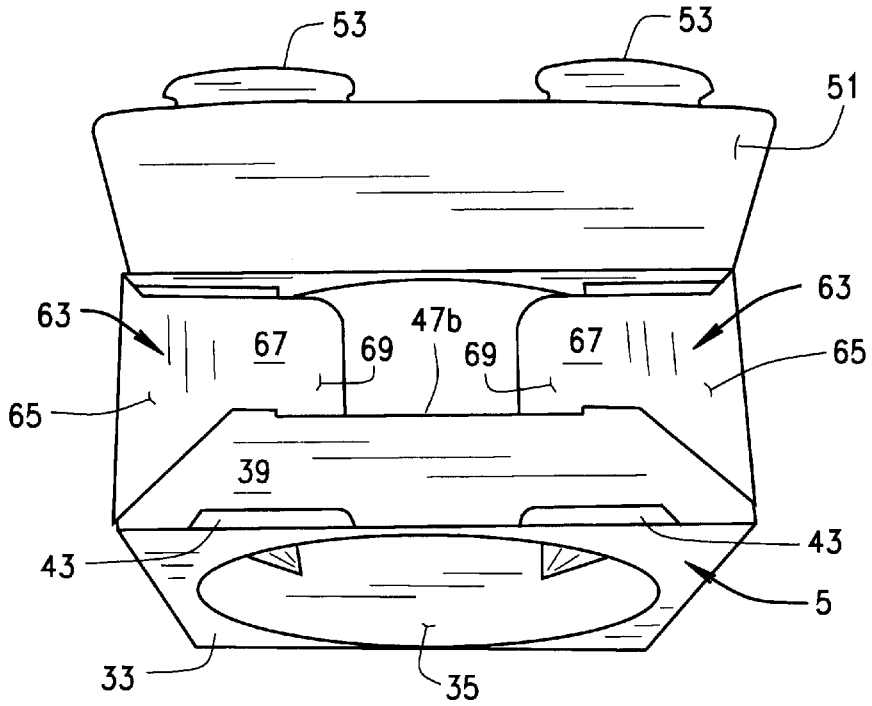
FIG. 5 is a front perspective view of the carton, showing the interlocking of the front end wall, to lock the carton closed without the use of glue.

The tabs 63 are then folded inwardly to overlay the inner front panel 39, as seen in FIG. 5. As seen, the bottom edge of the tab neck 67 is approximately aligned with the edge 47*b* of the inner front panel cutout 47. Then, the tab ears 69 are positioned behind the inner front panel, as seen in FIG. 6. Hence, the base 65 and neck 67 are on a front side of the inner front panel 39, and the ears 69 are on a back side of the inner front panel 39. The interaction between the tabs 63 and the inner front panel 39 holds the blank in a box shape without the use of adhesive.

Lastly, the outer front panel 51 is folded along the fold line between the front panel 51 and the top panel 37 to overlay the tabs 63 and the inner front panel 39. The tabs 53 on the outer front panel 51 are bent along fold lines between the tabs and the outer front panel 51 and are inserted in the slots 43. The outer front panel tabs 53 are sized to engage the edges of the slots 43. The engagement of the tabs 53 with the slots 43 reinforces the interaction between the tabs 63 and the inner front panel 39 to further lock and hold the blank in its carton form.

As can be appreciated, because the diameter of the openings 15 and 17 is smaller then the diameter of the ball B, the blank 31 must be folded around the ball, to form the carton around the ball. When the carton is thus formed, the ball will be captured by the carton 1, as seen in FIG. 1. As described above, when the carton is folded, the edges 23 of the braces 21*a,b* and the edges 19 of the openings 15 and 17 will engage the ball, and frictionally grip the ball to substantially prevent unassisted movement of the ball B relative to the carton 1.

As various changes could be made in the above constructions without departing from the scope of the invention, it is intended that all matter contained in the above description or shown in the accompanying drawings shall be interpreted as illustrative and not in a limiting sense. For example, the angles of the braces 21*a* and *b* can be changed as desired. Additionally, the braces can be changed, such that all four braces are similar to the front braces 21*b* or so that they are all similar to the rear braces 21*a*. Further, the braces can be configured to extend in from the sides, front and back of the carton, rather than from the corners. These examples are merely illustrative.

What is claimed is:

1. A carton for holding a ball, the carton having a top wall, bottom wall, front wall, back wall, and side walls, the carton having a top-to-bottom heighth, less than the diameter of the ball;

the top and bottom walls having holes therein through which the ball protrudes when received in the carton, the holes being sized and having a curvature corresponding to the curvature of the ball at a plane of contact between the top and bottom walls and the ball so that the hole edges engage the ball substantially along the full circumference of the holes;

the carton further including braces extending into the carton, the braces having end edges and being sized to engage the ball;

said brace end edges being shaped to correspond to the curvature of the ball at the location of the engagement between the braces and the ball, such that the braces engage the ball along substantially the full length of the brace edges;

the engagement of the top and bottom walls and of the braces with the ball substantially preventing unassisted movement of the ball relative to the carton;

the carton being formed from a one-piece unitary paperboard blank, said blank including a back panel which forms the back wall of the carton;

first panel hingedly connected to one end of said back panel for forming one of said top and bottom walls of said carton and a second panel hingedly connected to an opposite end of said back panel for forming the other of said top and bottom walls of said carton;

an inner front panel hingedly connected to an end of said first panel along a side of said first panel opposite said back panel;

said inner front panel having a cut-out extending inwardly of an end of said inner front panel towards said first panel;

an outer front panel hingedly connected to an end of said second panel along a side of said second panel opposite said back panel;

side panels hingedly connected to opposite sides of said second panel to form said carton side walls;

flaps hingedly connected to ends of said side panels and extending beyond said second panel to be on opposite sides of said outer front panel when said blank is laid flat;

each of said flaps including a neck having a bottom edge which, when said blank is folded to form said carton, is generally aligned with a bottom edge of said inner front panel cut-out, and an ear extending from each said neck in a direction to allow said ear to be tucked behind said bottom edge of said inner front panel cut-out, such that, when said blank is folded into said carton, each of said flap necks is on one side of said inner front panel and the end of said ear is on the opposite side of said inner front panels;

said flaps engaging said inner front panel, to maintain said carton in a folded form without the use of glue.

2. The carton of claim 1, wherein the braces are positioned at corners of sail carton.

3. The carton of claim 1, wherein the braces are off-set from vertical and horizontal axes of the carton.

4. The carton of claim 1, wherein the carton is formed from a one-piece unitary paperboard blank.

5. The carton of claim 1, wherein said blank includes at least one slot formed along the hinge line between said first panel and said inner front panel and at least on tab hingedly connected to, and extending from, an end of said outer front panel;

said at least one slot and at least one tab being positioned to enable said a least one tab to be inserted in said at least one slot when said blank is folded o form said carton;

said tab engaging said slot to maintain said outer front panel in a closed position without the use of glue.

6. A one-piece blank for forming a carton for holding a ball, the blank comprising:

a back panel that forms a back of a upset carton;

a first panel hingedly connected to one end of said back panel for forming one of a to and bottom walls of said carton and a second panel hingedly connected to an opposite end of said back panel for forming the other of said top and bottom walls of said carton;

each said top and bottom walls having a hole formed therein and through which a ball protrudes and can be received within the formed carton;

an inner front panel hingedly connected to an end of said first panel along a side of said first panel opposite said back panel;

said inner front panel having a cut-out extending inwardly from an end of said inner front panel towards said first panel;

an outer front panel hingedly connected to an end of said second panel along a side of said second panel opposite said back panel;

side panels hingedly connected to opposite sides of said second panel to form sides of said carton;

flaps hingedly connected to ends of said side panels and extending beyond said second panel to be on opposite sides of said outer front panel when said blank is laid flat;

each of said flaps including a neck having a bottom edge which, when said blank is folded to form such carton, are generally aligned with a bottom edge of said inner front panel cut-out, and an ear extending from each said neck in a direction to allow said ear to be tucked behind said bottom edge of said inner front panel cut-out, such that, when said blank is folded into said carton, each of said flap neck is on one side of said inner front panel and ends of each of said ears are on an opposite side of said inner front panel;

said flaps engaging said inner front panel, to maintain said carton in a folded form without the use of glue:

said carton further including braces at each corner of the carton between the back panel, and the side panel, the side panels with each of said braces extending into the carton, the braces having end edges and being sized to engage the ball;

said braces and edges being shaped to correspond to the curvature of the ball at the location of the engagement between the braces and ball, such that the braces engage the ball along substantially the full length of the brace edges, the engagement of the top and bottom walls and the braces with the ball substantially preventing unassisted movement of the ball relative to the carton.

7. The blank of claim 6, including at least one slot formed along the hinge line between said first panel and said inner front panel and at least one tab hingedly connected to, and extending from, an end of said outer front panel;

said at least one slot and at least one tab being positioned to enable said at least one tab to be inserted in said at least one slot when said blank is folded to form said carton;

each said tab engaging a corresponding said slot to maintain said outer front panel in a closed position without the use of glue.

8. The blank of claim 6 wherein each of said flap ears extend generally perpendicularly to its corresponding said flap necks.

9. A one-piece blank for forming a carton for holding a ball, the blank comprising:

a back panel that forms a back of a set up carton;

a first panel hingedly connected to one end of said back panel for forming one of a top and bottom walls of said carton and a second panel hingedly connected to an opposite end of said back panel for forming the other of said top and bottom walls of said carton; each said top and bottom walls having a hole formed therein and through which a ball protrudes and can be received within the formed carton;

an inner front panel hingedly connected to an end of said first panel along a side of said first panel opposite said back panel; said inner front panel having a cut-out extending inwardly from an end of said inner front panel towards said first panel;

an outer front panel hingedly connected to an end of said second panel along a side of said second panel opposite said back panel;

side panels hingedly connected to opposite sides of said second panel to form sides of said carton;

flaps hingedly connected to ends of said side panels and extending beyond said second panel to be on opposite sides of said outer front panel when said blank is laid flat; each of said flaps including a neck having a bottom edge which, when said blank is folded to form such carton, are generally aligned with a bottom edge of said inner front panel cut-out, and an ear extending from each said neck in a direction to allow said ear to be tucked behind said bottom edge of said inner front panel cut-out, such that, when said blank is folded into said carton, each of said flap neck is on one side of said inner front panel and ends of each of said ears are on an opposite side of said inner front panel; said flaps engaging said inner front panel, to maintain said carton in a folded form without the use of glue;

said blank further including braces at each corner between the back panel and the side panels, the side panels, with each of said braces extending into the formed carton; the braces having end edges and being sized to engage the ball; said brace and edges being shaped to correspond to the curvature of the ball at the location of the engagement between the braces and ball, such that the braces engage the ball along substantially the full length of the brace edges; the engagement of the top and bottom walls and the braces with the ball substantially preventing unassisted movement of the ball relative to the carton;

at least one slot formed along the hinge line between said first panel and said inner front panel and at least one tab hingedly connected to, and extending from, an end of said outer front panel; said at least one slot and at least one tab being position to enable said at least one tab to be inserted in said at least one slot when said blank is folded to form said carton; each said tab engaging a corresponding said slot to maintain said outer front panel in a closed position without the use of glue;

said side panels comprise outer side panels; said blank further including inner side panels hingedly connected to opposite sides of said first panel, and forward brace forming panels hingedly connected on one side to said inner side panels and connected on another side to said inner front panels; said forward brace panels forming forward braces at opposite sides of said carton front when said carton is formed from the blank; said braces extending into said carton.

10. The blank of claim 9 including a connecting flap extending between said inner front panel and said forward brace forming panels.

11. The blank of claim 9 including rear brace forming panels connected on one side to a rear edge of said inner side panels and connected on another side to said outer side panels.

12. A one piece blank for forming a carton for holding a ball, said carton having braces extending from corners of said carton into said carton;

said blank including:

a back panel;

top and bottom panels hingedly connected to opposite sides of said back panel;

outer side panels hingedly connected to opposite sides of said top panel;

inner said panels hingedly connected to opposite sides of said bottom panel;

a front panel hingedly connected to an end of said bottom panel opposite said back panel;

forward race forming panels hingedly connected on one side to said inner side panels and connected on another side to said front panel;

rear brace forming panel connected on one side to a rear edge of said inner side panels and connected on another side to said outer side panels;

each said top and bottom panels having a hole formed therein and through which a all protrudes when received in the formed carton;

each sad formed forward brace forming panels and rear brace forming panels extending inwardly into the carton when formed, said braces provided for engagement with a ball along substantially the full length of the brace edges when a ball is located within the formed carton.

13. The blank of claim 12 including connecting flaps extending between said front panel and said forward brace forming panels.

14. The blank of claim 12 wherein said forward brace forming panels each comprise two triangular sections hingedly connected together.

15. The blank of claim 14 wherein said triangular sections of said forward brace forming panels define approximate right triangles.

16. The blank of claim 12 wherein each of said rear brace forming panel is generally triangular;

said blank further including a hinged connecting panel extending from at least one side of said rear brace forming panels to said outer side panels.

* * * * *